US007172366B1

(12) United States Patent
Bishop, Jr.

(10) Patent No.: US 7,172,366 B1
(45) **Date of Patent: *Feb. 6, 2007**

(54) GOLF COURSE ENVIRONMENTAL MANAGEMENT SYSTEM AND METHOD

(75) Inventor: Robert F. Bishop, Jr., Aiken, SC (US)

(73) Assignee: SubAir Systems, LLC, Graniteville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/400,862

(22) Filed: Apr. 10, 2006

(51) Int. Cl.
*E02B 11/00* (2006.01)
*A01G 9/24* (2006.01)

(52) U.S. Cl. ..... 405/37; 405/43; 405/45; 47/1.01 R; 47/58.1 R; 137/78.3; 700/284; 239/63

(58) Field of Classification Search ..... 405/36, 405/37, 43, 45, 269, 258; 47/107 R, 107 F; 37/58.1 R; 137/78.1–3, 79; 700/287; 239/63–65
See application file for complete search history.

(56) References Cited

U.S. PATENT DOCUMENTS

| | | | |
|---|---|---|---|
| 3,599,867 | A | 8/1971 | Griswold et al. |
| 3,726,477 | A | 4/1973 | Shapiro |
| 4,194,691 | A | 3/1980 | Birnbach et al. |
| 4,244,022 | A | 1/1981 | Kendall |
| 4,626,984 | A | 12/1986 | Unruh et al. |
| 5,148,125 | A | 9/1992 | Woodhead et al. |
| 5,219,243 | A | 6/1993 | McCoy |
| 5,433,759 | A | 7/1995 | Benson |
| 5,507,595 | A | 4/1996 | Benson |
| 5,542,208 | A | 8/1996 | Benson |
| 5,596,836 | A | 1/1997 | Benson |
| 5,617,670 | A | 4/1997 | Benson |
| 5,634,294 | A | 6/1997 | Rohoza |
| 5,636,473 | A | 6/1997 | Benson |
| 5,752,784 | A | 5/1998 | Motz et al. |
| 5,924,238 | A | 7/1999 | Yanohara |
| 5,944,444 | A | 8/1999 | Mortz et al. |
| 6,018,909 | A | 2/2000 | Potts |
| 6,088,959 | A | 7/2000 | Wait et al. |
| 6,220,957 | B1 | 4/2001 | Clarkson |
| 6,273,638 | B1 | 8/2001 | Clarkson |

(Continued)

FOREIGN PATENT DOCUMENTS

| | | |
|---|---|---|
| JP | 04051825 | 2/1992 |

*Primary Examiner*—Frederick L. Lagman
(74) *Attorney, Agent, or Firm*—McNair Law Firm, PA; Cort Flint

(57) ABSTRACT

The invention is a system and method for managing a plurality of areas of interest of a golf course. The system comprises a plurality of subsurface aeration subsystems and a programmable master control module. Each subsystem provides to a specific area at least one of air under pressure and a partial vacuum. In each area of interest, a local control module is responsive to a directive and to a datum (environmental or operational parameter). The local control module is configured to operate the subsystem and is in communication with the programmable master control module. The programmable master control module receives from the local control modules area information representing a status of the respective specific area to which the local control module is dedicated, and in response to the area information and to a command, the programmable master control module issues a directive to the local control module to operate the subsurface aeration subsystem.

45 Claims, 11 Drawing Sheets

U.S. PATENT DOCUMENTS 6,364,628 B1 4/2002 Potts et al.
6,997,642 B2 * 2/2006 Bishop, Jr. ..... 405/37
7,012,394 B2 * 3/2006 Moore et al. ..... 405/37

* cited by examiner

EQUIPMENT PANEL

LOCAL DISCONNECT (FUSED)
TRANSFORMER (IF 480 VAC SUPPLY)
MOTOR CONTACTOR
MOTOR OVERLOADS
CURRENT SWITCH
(CONTACT CLOSE @ > 2 AMPS)

RELAYS:
- MOTOR START
- AIR REVERSING VALVE & ACTUATOR FOR ONE VAULT TO TWO GREENS (DOUBLE VAULT)
  - DIVERTER ACTUATOR GREEN A
  - DIVERTER ACTUATOR GREEN B

PANEL DOOR SWITCH -
- ON VACUUM / ON PRESSURE

PANEL DOOR FAULT LIGHT
- (OVERLOAD / UNDERLOAD / FLOODED VAULT)

MOISTURE / TEMPERATURE SENSOR
(IF REQUESTED)

COMMUNICATION & CONTROL

OUTPUTS TO PANEL
- BLOWER ON
- AIR REVERSING VALVE TO PRESSURE POSITION (AT REST IS VACUUM) FOR ONE VALVE TO TWO GREENS
  - OPEN DIVERTER VALVE TO GREEN A
  - OPEN DIVERTER VALVE TO GREEN B

INPUTS FROM PANEL &FIELD DEVICES:
- MOTOR OVERLOADS DROPPED OUT
- CURRENT < 2 AMPS WHEN RUNNING
- VAULT FLOODED
- GREEN MOISTURE
- GREEN TEMP
- AMBIENT TEMPERATURE (IF REQUESTED)

LOGIC REQUIREMENTS:
- BLOWER ON BASED ON - TIME OF DAY
- BLOWER ON BASED ON - TEMPERATURE & / OR MOISTURE (IF REQUESTED)
- VACUUM TO GREEN
- PRESSURE TO GREEN
- GREEN A & / OR GREEN B (IF DOUBLE VAULT)
- SHUT DOWN / DO NOT START IF FLOODED

FIG. 12

GOLF COURSE ENVIRONMENTAL MANAGEMENT SYSTEM AND METHOD

CROSS-REFERENCE TO RELATED APPLICATIONS

This application claims priority to and the benefit of U.S. provisional patent application Ser. No. 60/447,169, filed Feb. 12, 2003; U.S. provisional patent application Ser. No. 60/447,218, filed Feb. 12, 2003; U.S. patent application Ser. No. 10/777,466, filed Feb. 12, 2004, now abandoned; U.S. patent application Ser. No. 10/777,491, filed Feb. 12, 2004, now abandoned; U.S. patent application Ser. No. 10/916,187, filed on Aug. 11, 2004, now U.S. Pat. No. 7,012,394; U.S. patent application Ser. No. 10/935,205, filed on Sep. 7, 2004, and U.S. Pat. No. 6,997,642; and co-pending U.S. patent application Ser. No. 11/331,793, filed on Jan. 12, 2006, each of which applications is incorporated herein by reference in its entirety.

BACKGROUND OF THE INVENTION

The invention relates to subsurface aeration systems in general and particularly to a subsurface aeration system servicing a plurality of areas of interest of a golf course.

Prior systems are known for treating soil and turf by blowing and/or vacuuming through a duct network located underneath the turf. A high pressure, high-volume air pump is typically used to move air into the soil profile or remove moisture from the soil profile. For example, U.S. Pat. Nos. 5,433,759; 5,507,595; 5,542,208; 5,617,670; 5,596,836; and 5,636,473, the disclosure of each of which is incorporated herein by reference, show different versions of equipment used for this purpose. Since an air pump or non-reversing fan discharges air from one connection and pulls in air from another, changing the system from a blowing function to a vacuuming function requires disconnecting the duct network from the blowing outlet of the fan unit and connecting it to the vacuum inlet of the unit. For this purpose, various valves and/or couplings can be used to avoid the hassles involved with selectively connecting and disconnecting the duct network from the various ports of the air pump unit. Manual operations limit the degree to which the usage can be automated. In addition, considerable judgment is involved in knowing when to blow air into the duct network and when to remove air from the duct network by applying a partial vacuum. For example, blowing air into the duct network when there is too much moisture in the soil profile can severely damage parts of the turf.

More recently, U.S. Pat. No. 6,273,638, the disclosure of which is incorporated herein by reference, discloses additional features of an air handling system that includes an air handling device connectable to a duct network that is underneath a field having grass growing in it, at least one sensor disposed to measure a variable associated with the field, and a control unit connected to the air handling device to control operating parameters of the air handling device responsive to an output from the sensor. A heat exchanger is optionally part of the system. The variables associated with the field include temperature and moisture. The operating parameters of the air handling device include direction of the air flow, temperature of the air directed into the duct network, and the time of operation of the unit. The system optionally includes programmable control logic so that the sensor output automatically controls the operating parameters of the system. A computer with display is used to program the control logic, which can be done remotely over a modem or the internet. The sensor output can be viewed on the display to allow a user to manually control the operating parameters if desired.

What is lacking are systems that can be operated that can handle a diversity of environmental parameters over disparate areas of interest.

SUMMARY OF THE INVENTION

In one aspect, the invention relates to a system for managing a plurality of areas of interest within a golf course. The system comprises a plurality of subsurface aeration subsystems, each subsystem dedicated to a specific area of the golf course. Each subsystem comprises a subsurface aeration conduit for providing to the specific area of the golf course at least one of air under pressure and a partial vacuum, and an air pump in fluid communication with the subsurface aeration conduit, the air pump configured to provide at least one of air under pressure and a partial vacuum within the conduct. A motor is mechanically connected to the air pump and a local control module responsive to a directive and to a datum is provided. The local control module is operatively coupled to the motor; and at least one sensor measures an environmental parameter in data communication with the local control module. A programmable master control module is in communication with each of the plurality of local control modules. The programmable master control module receives from the local control modules area information representing a status of the respective specific area to which the local control module is dedicated, and in response to the area information and to a command, the programmable master control module issues a directive to the local control modules to operate the subsurface aeration subsystem.

In one embodiment, the subsurface aeration conduit is a device used to supply air under pressure to or withdraw air under vacuum from the subsurface of the area of interest on the golf course. Preferably, the subsurface aeration conduit is a selected one of interconnecting perforated pipe, interconnecting porous pipe and channels formed by a placement of spacing devices.

The programmable master control module can be a selected one of a programmable computer, a programmable logic controller (PLC), and a programmable industrial controller. The programmable master control module communicates with a selected one of the plurality of local control modules by way of a hard-wired communication link, a wireless communication link, and a fiber-optic communication link.

The programmable master control module may comprise a connection to a communication network. In one embodiment, the communication network comprises a selected one of a telephone communication link, a wireless communication link, an optical communication link, and a packet-switched communication link.

The system may communicate information over the selected communication link to a user at a remote location, and receive a command over the selected communication link from a user at a remote location. In another aspect, at least one of the local control modules further comprises a communication link accessible by way of a hand-held battery-powered device selected from one of a cellular telephone, a personal digital assistant (PDA), and a pocket personal computer (pocket PC).

Preferably, at least one subsurface aeration subsystem further comprises a reversing mechanism in fluid communication with the air pump and with the subsurface aeration conduit, the reversing mechanism configured to cause air to flow in a first flow direction to provide air under pressure, and configured to cause air to flow in a second flow direction to provide a partial vacuum. In one embodiment, the reversing mechanism is responsive to the local control module.

The sensor that measures an environmental parameter may comprise a sensor that measures at least one of a temperature, a moisture content, an illumination, a chemical concentration, and a motion.

In another aspect, the programmable master control module comprises a data recording and analysis module configured to record a selected one of a parameter relating to aeration, a parameter relating to irrigation, an operating parameter of an air pump, a temperature, a moisture content, a parameter relating to an additive applied to irrigation water, and a time. In one embodiment, the data recording and analysis module is configured to analyze one or more parameters relating to aeration, to irrigation, to operation of an air pump, to a temperature, to a moisture content, to an additive applied to irrigation water, and to a time. In one embodiment, the data recording and analysis module is configured to compare a selected parameter to a setpoint. In one embodiment, the data recording and analysis module is configured to determine a status of at least one of the subsurface aeration subsystems.

The programmable master control module may further comprise a master display which exhibits a status of at least one of the subsurface aeration subsystems. The status may be selected from one of a time when the subsurface aeration subsystem begins to operate, duration of operation of the subsurface aeration subsystem, an operating parameter of the subsurface aeration subsystem, a environmental condition, a fault condition, an actionable condition, a setpoint, and a directive. In one embodiment, the operating parameter of the subsurface aeration subsystem comprises a selected one of an electrical current, a pressure, a vacuum, a temperature, an air flow, and a water flow. The environmental parameter may comprise a selected one of a soil temperature, an ambient temperature, a moisture content, an amount of solar radiation received in a specified time period, a soil salinity, and a detection of motion. In one embodiment, the ambient temperature is an ambient air temperature, and the moisture content is a selected one of a soil moisture content and an air humidity.

The programmable master control module may comprise an input device for receiving commands from a user of the system. In one embodiment, the input device for receiving commands from a user of the system comprises a selected one of a keyboard, a key pad, a touch pad, a touch screen, a mouse, a joystick, a light pen, a pointing device, and a microphone. In one embodiment, the command is a command received from a user.

The command may be a command received from a computer program operating on the programmable master control module, and the temperature is a selected one of a soil temperature and an ambient temperature.

Preferably, the subsurface aeration subsystems comprise a local display. In one embodiment, the local display exhibits a status of the subsurface aeration subsystem. In one embodiment, the status is a selected one of a time when the subsurface aeration subsystem begins to operate, a duration of operation of the subsurface aeration subsystem, an operating parameter of the subsurface aeration subsystem, a environmental condition or parameter, a fault condition, an actionable condition, and a directive. The operating parameter of the subsurface aeration subsystem may comprise a selected one of an electrical current, a pressure, a vacuum, an air flow, and a water flow. The environmental condition may comprise a selected one of a soil temperature, an ambient temperature, a moisture content, an amount of solar radiation received in a specified time period, a soil salinity, and a detection of motion. The moisture content is a selected one of a soil moisture content and an air humidity.

The local control module may be implemented as a virtual local control module on the programmable master control module. Preferably, the areas of interest comprise at least a plurality of one or more golf greens, one or more fairways, one or more tee boxes, one or more walkways, one or more gallery viewing areas, one or more driving ranges, one or more putting greens, and one or more practice areas.

In a accordance with the invention, a method for managing the environment of a plurality of areas of interest within a golf course comprises the steps of providing a plurality of subsurface aeration systems at the areas of interest, each subsurface aeration system being dedicated to a specific area of interest and including a conduit for providing to the specific area one of a vacuum and air under pressure for reducing a temperature of the soil, an air pump in fluid communication with the subsurface aeration conduit configured to establish one of a vacuum and air under pressure in the conduit, a motor mechanically connected to the air pump, and a sensor that measures an ambient air temperature. Next, the method provides local control modules coupled to associated ones of the subsurface aeration systems to control the operation thereof in response to a directive; and a master control module is provided in communication with the local control modules. The method includes receiving at the master control module area information sent from the local control modules representing the ambient air temperature; and determining whether a condition exists for reducing the temperature of the soil at an area of interest in response to receiving the ambient air temperatures. If the condition exists, a directive from the master control module is issued to one or more local control modules causing operation of an associated subsurface aeration system to create an air flow in an aeration conduit for reducing a temperature of soil at the area of interest.

The method includes connecting the master control module in communication with the local control modules by one of a hard-wired communication link, a wireless communication link, and a fiber-optic communication link. The local control modules may be accessed by way of a hand-held battery-powered device selected from one of a cellular telephone, a personal digital assistant (PDA), and a pocket personal computer (pocket PC).

Determining the condition includes determining whether the ambient air temperature is less than a soil temperature by a prescribed amount, that the soil temperature is higher than a specified temperature setpoint and the directive causes the subsurface aeration system to establish the vacuum in the aeration conduit so that air is drawn downward though the soil at the area of interest for reducing the temperature of the soil. In a further aspect, determining whether the ambient air temperature exceeds a soil temperature includes determining whether the ambient air temperature is higher than or equal to a first setpoint value, the soil temperature is higher than or equal to a second set point value, and the first setpoint value is less than the second setpoint value. The method may include repeating from time to time the determining step and, when the condition exists, issuing from the master control module a directive to one or more local control modules to operate the associated subsurface aeration systems for reducing a temperature of the soil.

In another aspect, the method includes receiving at the programmable master control module area information sent from the control module representing ambient air temperature, a soil temperature, and soil moisture content. Determining the condition includes determining whether the ambient air temperature is greater than the soil temperature at an area of interest by an amount that makes heat transfer efficient, that the soil temperature is higher than desired, and whether the soil moisture is below a setpoint. The directive includes operating the subsurface aeration system to establish the air under pressure in the aeration conduit so that air flows upward through the soil for reducing a temperature of soil at the area of interest. The method includes cooling the ambient air by passing the air through at least a portion of the subsurface aeration conduit configured as a heat exchanger in contact with cooler subsurface soil when establishing air under pressure.

In another aspect, the method for managing the environment of a plurality of areas of interest within a golf course comprises determining whether a condition exists for increasing the temperature of soil at one or more areas of interest in response to receiving the ambient air temperature. If the condition exists, a directive is issued from the master control module to one or more local control modules causing operation of an associated subsurface aeration system to establish one of the vacuum or air under pressure in the aeration conduit for increasing a temperature of soil at the area of interest. Determining the condition includes determining whether the ambient air temperature is greater than a soil temperature by a prescribed amount for efficient heat transfer, and the directive causes the subsurface aeration system to establish the vacuum in the aeration conduit so that air is drawn downward though the soil at the area of interest for increasing the temperature of the soil. In a further aspect, determining the condition includes determining whether the ambient air temperature is sufficiently greater than the soil temperature at an area of interest for efficient and effective heat transfer, and the directive includes operating the subsurface aeration system to establish the air under vacuum in the aeration conduit so that air flows downwardly through the soil for increasing a temperature of soil at the area of Interest. The method includes repeating from time to time the determining step and, when the condition exists, issuing from the master control module a directive to one or more local control modules to operate the associated subsurface aeration systems for increasing a temperature of the soil.

The method may include heating the air by passing air through at least a portion of the subsurface aeration conduit configured as a heat exchanger in contact with warmer subsurface soil when establishing a flow of the air under pressure.

It is believed that there has been no prior system and method such as described and claimed herein that has been used with regard to golf courses. Some sports fields, including the soccer field of Manchester United (U.K.), the soccer field of Kilmarnock (U.K.), the baseball and softball fields at the University of Nebraska, and the football field of the Denver Broncos in Denver, Colo., have employed similar methods of operation to those described herein. However, as stated above, it is believed that the varied conditions found in golf courses, which are appreciably different from the conditions found in a single unvarying expanse such as a football, a baseball, a softball or a soccer field, makes the application of the systems and methods of the invention to golf courses novel. See the first paragraph of the Detailed Description for examples.

The foregoing and other objects, aspects, features, and advantages of the invention will become more apparent from the following description and from the claims.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 12 is an enumeration of some of the components, communication and control channels, and logic structure of one or more embodiments of the golf course environmental management system, according to principles of the invention.

DETAILED DESCRIPTION OF A PREFERRED EMBODIMENT

The systems and methods according to the present invention are useful in managing the operation of subsurface aeration systems to a plurality of locations, for example areas having different requirements from one another. As will be explained in greater detail below, an example that illustrates the above advantages and solutions in the provision of subsurface aeration and associated services is discussed with reference to a golf course that has a plurality of greens or other areas of interest having different requirements. Different areas on a golf course can have differences in many features, such as in topography, in elevation, in exposure to the sun, and in other features such as water table level, or being subject to wind. For example, a first green is surrounded by a water hazard (for example, a green situated on an island surrounded by water and accessible by a footbridge or golf cart path); a second green is surrounded by sand traps; a third green is exposed to full sun for much or all of a day; and a fourth green is surrounded by trees that shade the green from direct sunlight for a considerable part of the day. Different greens may have different soil conditions and/or different elevations, some may be sloped or terraced; and some may be subject to other unique conditions, such as prevailing winds, or exposure to salt water or salt spray (for example a course situated at the ocean).

Figure 1:
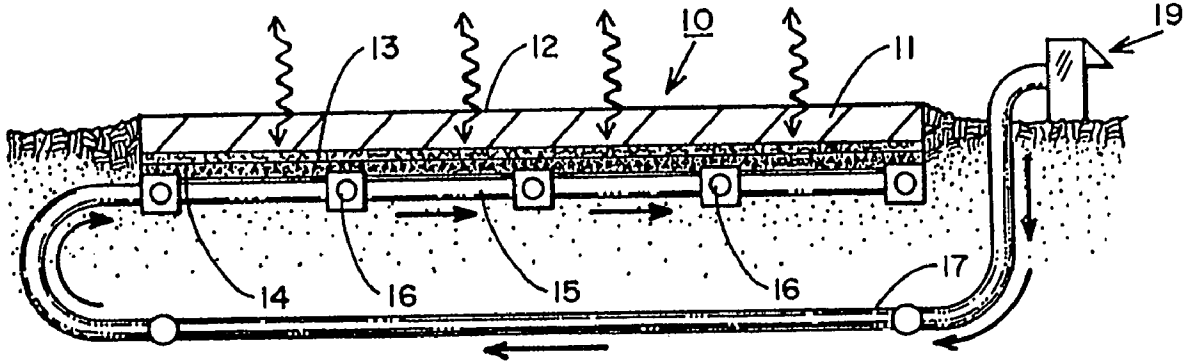
FIGS. 1 and 2 illustrate known prior art systems for treating soil and turf by supplying or removing air through a duct network disposed underneath the turf of a sports playing field or golf green.
Figure 2:
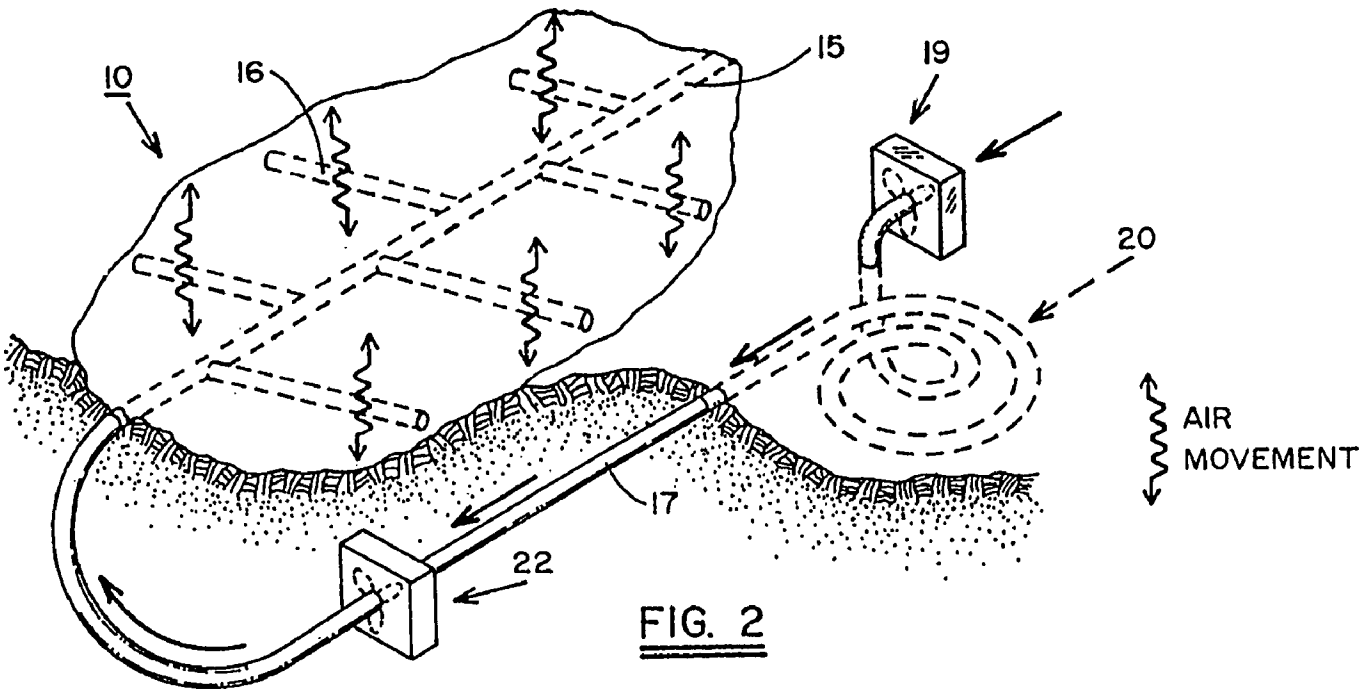
FIG. 2 PRIOR ART

Turning to FIGS. 1 and 2, there is shown a known system for temperature moderation of a golf course green generally referenced 10, as disclosed in U.S. Pat. No. 5,433,759. Although the present invention will be explained in detail with reference to the treatment of the turf and subsoil of a golf green, it will be understood, of course, that the present invention can be used in many other similar applications. Outdoor sports stadiums having grass playing fields are examples of sites where subsurface soil treatment is desirable.

The green depicted in FIG. 1 is one that has been constructed in compliance with the specifications of the United States Golf Association (USGA). The green includes a top layer 11 that supports a grass turf 12. The top layer is about twelve inches deep and contains a mix that is 80% fine sand and 20% organic matter which is typically peat moss. Immediately below the top layer may be an intermediate layer 13 that is about two to four inches deep and contains choker sand. Finally, a lower layer 14 of pea gravel about four inches deep is placed directly below the sand layer(s).

Typically, buried in the subsoil of the green is a duct network that is in communication with the lower level gravel bed and serves to carry excess water in the subsoil region away from the green. The duct network includes one or more main feeder lines 15 that are interconnected to a series of distribution lines 16—16. In the embodiment shown, the lines are arranged in a herringbone pattern that encompasses the green area. In another embodiment, the lines can be arranged as a series of parallel pipes connected along a common border or edge. The lines have openings that permit excess moisture in the soil to be collected in the lines. The lines are laid in the ground so that the collected moisture is gravity fed to the drainage system servicing the golf course. As will be explained in greater detail below, in accordance with the present invention, existing duct network can be retrofitted to the present system to provide underground heating, cooling and other beneficial treatment to the subsoil and turf of the green.

As shown in FIG. 1, the main feeder lines 15 are connected to a supply line 17 which, in turn, is connected to the outlet side of a blower or an air pump 19. A portion of the supply line, shown in FIG. 1 as a linear section, is buried below the surface of the ground at a depth wherein the ground temperature is relatively constant and not readily responsive to changes in ambient air temperature, for example at a depth of between two and ten feet.

The length of the linear section is such that sufficient energy is exchanged between the ground and the air moving through the line to bring the air temperature close to the ground temperature. The linear section of the line thus acts as a ground source heat pump to either heat or cool the air moving through the line, depending upon the temperature of ambient air drawn into the air pump as compared to the ground temperature. In one mode, warm air under pressure is cooled from the initial ambient air temperature by virtue of conductive heat transfer to the subsurface aeration conduit and subsurface media (sand, soil, gravel, stone) when the conduit and the media are at a lower temperature than the ambient air temperature. The cooled air moves through the soil at the area of interest and reduces this soil temperature by virtue of conductive heat transfer. In another mode, ambient air under pressure is warmed in the conduit for increasing the heat of the soil profile when the ambient air temperature is lower than conduit and media temperatures.

The air pump can be located some distance from the green either above or below ground and is insulated to reduce noise which might distract golfers playing the course. The air pump is adapted to draw in ambient air and deliver it through the lines to the duct network under the green. The air is pumped at relatively low pressure and at a high volume to prevent undue heating of the air and is distributed into the subsoil by means of openings or nozzles formed in the duct lines. The air is thus forced upward through the approximate 4 inch gravel and 12 inch soil profile to provide either heating or cooling of both the soil and the turf.

In the event the ambient air temperature is relatively high, and the soil temperature surrounding and just below the turf is relatively high, the air will be cooled as it moves through the relatively cooler subsurface soil and gravel beneath the turf thus providing cooling to the turf area or area of interest. If the ambient air temperature is relatively low, and the soil temperature surrounding and just below the turf is relatively low, the air moving through the system will be increased by the relatively warmer subsurface soil thus providing heating to the turf area.

As disclosed in U.S. Pat. No. 5,433,759, a reversing valve unit has a first position when the air pump is providing cooling or heated air to the duct network under the turf. Ambient air is delivered to the air pump via an inlet line and the air pump air discharge is pushed through the heat exchanger and the duct network. Reversing the valve positions causes the air pump to draw ambient air downwardly through the green soil profile. Any excess moisture or water in the subsoil is thus pulled into the duct network beneath the green. The network is arranged to drain into a sump from which it is exhausted into the main drainage system servicing the golf course.

When air is being pumped into the duct network, air is delivered under pressure through the pipe line into the gravel bed so that the air is distributed uniformly throughout the bed and then driven upwardly to penetrate the entire soil profile. The flow of air through the soil is employed to either heat or cool the turf, depending on the prevailing ambient air and ground conditions. The flow of air through the soil also provides an added benefit in that it serves to aerate the soil and thus promotes the health and growth of the grass turf. When the suction side of the air pump is connected with pipe lines in the duct network, a sufficient suction or partial vacuum is provided to draw ambient air downwardly through the soil profile into the gravel distribution bed to again provide the desired heating or cooling of the grass turf. A further benefit of the suction mode of operation is that it affords rapid removal of excess water from the soil profile during periods of heavy rain or flooding. Excess water in the soil is drawn quickly down into the gravel bed and collected in the pipe lines. As disclosed in U.S. Pat. No. 5,507,595, the moisture laden air stream may be drawn into a water separator unit where the moisture and any airborne particulates are removed from the air stream and delivered to a holding tank without interrupting the operation of the air pump. The present apparatus can, in addition, continuously collect and drain moisture when operating in the pumping or suction mode. Alternatively, the air pump operation may be terminated periodically for a short period of time allowing any water collected in the duct lines to be gravity fed to the drain system, where the water can flow away from the green or other area of interest.

Referring to the drawings, an illustrated embodiment of a golf course environmental management system and method for managing a plurality of areas of interest within a golf course will now be described in more detail. The system and method of the invention use one or more sensors to provide area information about the state of various environmental variables, such as an ambient air temperature, a soil temperature, and/or a soil moisture content. The system and method disclosed use the area information to determine whether there is a need to adjust one or more of the environmental conditions, and if so, how best to effect the necessary adjustment or adjustments.

In describing the system of the invention, the term "directive," as used herein, is intended to mean an instruction from the programmable master control module to a local control module. The term "command" as used herein is intended to mean a computer instruction of a program operating on a computer or an instruction of a control logic sequence of a logic controller, or a user command for the programmable master control module. A user who issues directions of any kind to a local control module directly can be understood to have issued a directive even if the word "command" is used to express the user's action. The term "fault condition" as used herein is intended to mean that some subsurface aeration component or a local control module is not in proper operating order, and should be attended to (e.g., fixed, replaced). The term "actionable condition" as used herein is intended to mean that some environmental condition (such as a temperature or a moisture content) is out of tolerance and needs to be corrected by operating the system, but does not imply anything about the condition of the subsurface aeration components. The term "setpoint" as used herein in intended to mean a value set by default, by a computer program, or by an operator to define a desired value of a parameter or condition, or an extremum of a range of acceptable values. An actionable condition occurs when a setpoint is deviated from, or an extremum of a range is exceeded. The term "closed loop operation" is well known in the computer control arts, and generally is understood to mean that a system uses a value generated as an output of a process as an input variable. "Closed loop operation" is distinguished from "open loop operation," which is used to describe a system that sets a control parameter with an eye to obtaining a specific output, but does not monitor an output variable for using in correcting the operation of the system. In the present invention, "closed loop operation" is also used to connote that the system will start and stop automatically based on the value or values of one or more variables such as the actual temperature and moisture content of soil or turf, and the ambient air temperature, which are compared to criteria or setpoints by a computer program of logic controller.

Figure 3:
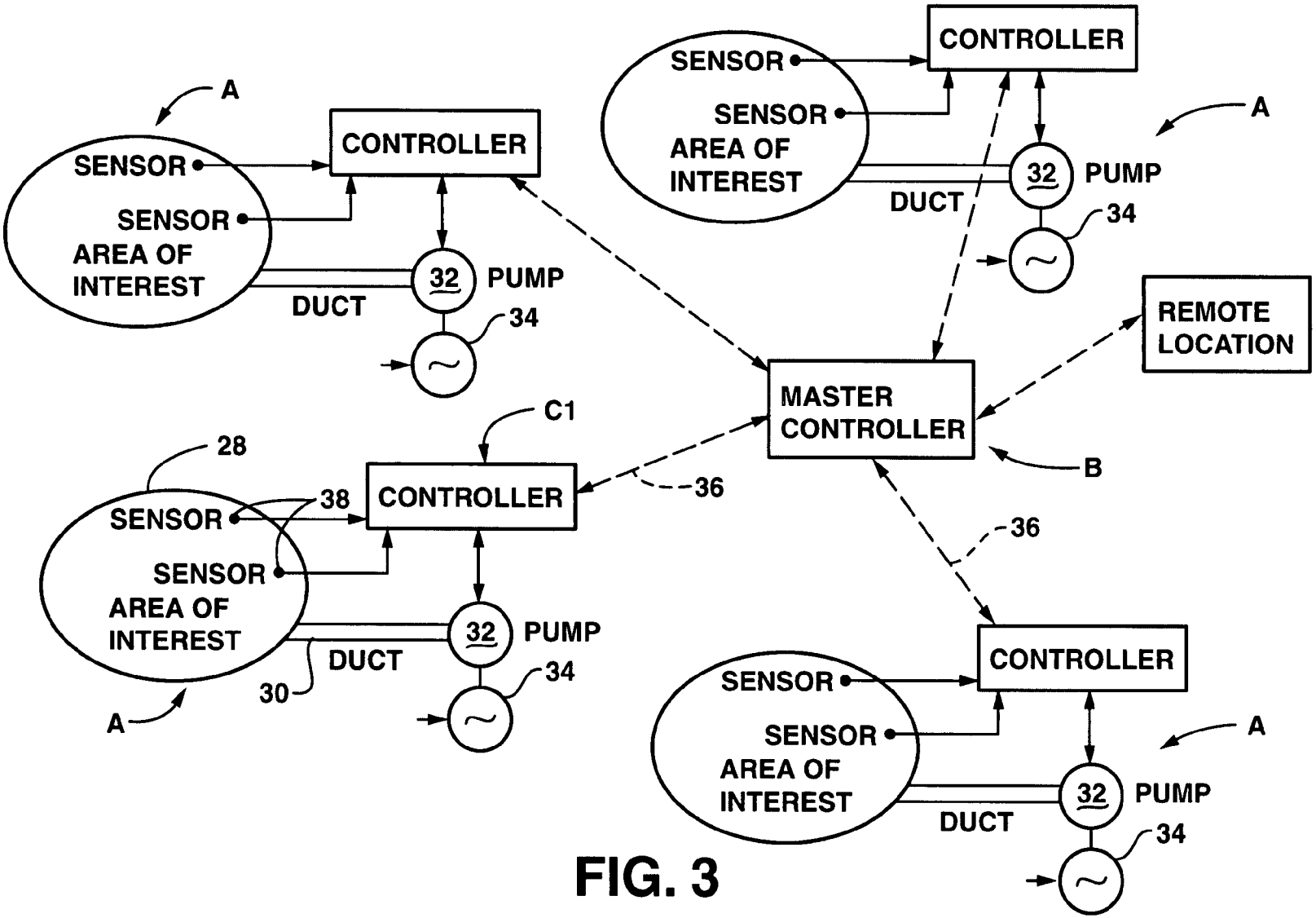
FIG. 3 is a drawing showing a plurality of subsurface aeration subsystems, each subsystem dedicated to a specific area of a golf course, and communicating with a programmable master control module, according to principles of the invention.

FIG. 3 is a schematic illustration of a plurality of subsurface aeration subsystems A, each subsystem dedicated to a specific area 28 of a golf course, and communicating with a programmable master control module or controller B. Each subsurface aeration system comprises a subsurface aeration conduit or duct 30, and an air pump 32 in fluid communication with the subsurface aeration conduit for providing to the specific area of the golf course at least one of air under pressure and a partial vacuum. The air pump is configured to provide at least one of air under pressure and a partial vacuum, as has been described hereinabove. A motor 34 is mechanically connected to the air pump. A local control module (controller) C is provided that is operatively coupled to the motor. The local control module is responsive to a directive 36 and to a datum. The subsurface aeration system may comprise at least one sensor 38 that measures an environmental parameter. The at least one sensor is in data communication with the local control module. The programmable master control module receives from the local control modules area information representing a status of the respective specific area to which the local control module is dedicated, and in response to the area information and to a command, the programmable master control module issues directive 36 to the local control module to operate the subsurface aeration subsystem.

Local control modules C of the subsurface aeration subsystems receive data from sensors 38 provided for the respective areas of interest. The local control modules may be a PLC, and include a communication link accessible by way of a hand-held battery-powered device selected from one of a cellular telephone, a personal digital assistant (PDA), and a pocket personal computer (pocket PC). The sensors can monitor environmental parameters such as ambient air temperature, soil temperature, soil moisture, soil salinity, air pressure within a conduit, and solar radiation level, as well as other parameters such as motion within an area of interest, an image of an area of interest, sounds present at an area of interest and other information that may be useful in operating the system of the invention. The sensors may provide data to the respective local control modules as raw data, as digital data, or as data in a specified format.

The system of the present invention may use a wireless networking technology for communication between the local control modules and the programmable master control module. Advantages of a wireless system over a hard-wired system can include greater ease of installation, lowered cost of installation, greater speed of installation, and reduced chance of damage by lightning strikes as a result of the absence of a large "antenna" or "target" for lightning represented by miles of copper wiring. In a retrofit situation, a wireless installation can represent a smaller disruption to the operation of the golf course as compared to installing a hard-wired system. The communications can also be implemented using a hard-wired communication link, a fiber-optic communication link, or any other conventional communication link that can handle the transmission of data and instructions. In some embodiments, the system has the capability to communicate by way of a communication network, such as the Internet. In one embodiment, the communication network comprises a selected one of a telephone communication link, a wireless communication link, an optical communication link, and a packet-switched communication link. In one configuration, the system comprises eighteen (18) subsurface aeration subsystems, each one dedicated to a green of a golf course. However, the system can also be used with other portions of a golf course, such as one or more golf greens, one or more fairways, one or more tee boxes, one or more walkways, one or more gallery viewing areas, one or more driving ranges, one or more putting greens, and one or more practice areas.

Programmable master control module B may be configured to receive area information from local control modules C, and to send directives 36 to the local control modules. The programmable master control module may be a programmable computer, a programmable logic controller (PLC), or a programmable industrial controller. The programmable master control module is programmed with software. The software may be a computer program comprised of one or more computer instructions recorded on a machine-readable medium. When the computer program is executing on the programmable master control module, one or more setpoints are defined for the operation of each subsurface aeration subsystem. The programmable master control module can compare a setpoint (or a range of acceptable values defined by a first extremum, such as a low soil temperature setpoint, and a second extremum, such as a high soil temperature setpoint, to an actual value of an environmental parameter observed by a sensor. A single value setpoint can include a tolerance about the setpoint (e.g. X degrees F., plus or minus 0.5 degrees F.). If the actual value of the environmental parameter is within an acceptable range, the programmable master control module can indicate that fact to a user of the system, for example, by displaying on a display the value in green. Programmable master control module B can determine if an actionable condition exists, for example when one or more actual values of environmental parameters fall outside acceptable ranges. If the actual value is outside of an acceptable range, the programmable master control module can indicate that an actionable condition exists, and the fact that caused the actionable conditioner to a user of the system, for example, by displaying on a display an out-of-range value in red, by displaying the value with a unique font or a unique visual or audible attribute, by for example by flashing the value or emitting a sound. Optionally, the display also indicates the acceptable range for the out-of-range value. In some embodiments, the programmable master control module displays in a defined manner to a user the values of parameters that are being controlled to bring an out-of-range parameter within an acceptable range, for example displaying a value in yellow while the value is out-of-range and the system is taking action to adjust or correct the value. Similar displays are optionally provided at local control modules when a user is operating the respective local control system directly, and/or at a remote location when a user is communicating with the system from such a remote location.

The programmable master control module can be programmed to institute a remedial action if an actionable condition exists. For example when one or more actual values of environmental parameters fall outside acceptable ranges, the programmable master control module determines the status of the particular area of interest. In some embodiments, a truth table is provided for each area of interest, including at least the one or more setpoints or setpoint-defined ranges for environmental parameters. The programmable master control module determines what corrective or remedial action should be instituted by performing one or more operations, such as comparing the status to a list of predefined remedial actions to be issued as directives, or by performing logical operations configured to yield one or more directives. The programmable master control module issues one or more directives to the respective local control module to operate the respective subsurface aeration subsystem to take the remedial action. The programmable master control module can be configured advantageously to repeat from time to time the determination of the status of the particular area of interest, and while the determination indicates that additional remedial action is needed, directing the local control module to operate the subsurface aeration system to perform the necessary action. When the programmable master control module determines that the status of the area of interest conforms to the acceptable setpoint values, the programmable master control module directs the local control module to turn off the subsurface aeration system.

Programmable master control module B may be programmed to accept commands from an authorized user of the system, for example from a greens keeper, using an input device such as a keyboard. The system may be programmable to require that the user identify his- or herself to the system, for example with a token, such as a user name, a key, or a machine-readable card, and/or with a password or identification number, so as to prevent unauthorized operation of the system. In some embodiments, the system can transmit information for display to a user at a remote location and can receive information and commands from the user. For example, the greens keeper can review the status of one or more areas of a golf course from home, and as needed, can control the actions of the system from that remote location. The input and/or responses of the user can include commands, answers to queries and/or replies to information (by way of dialog boxes, radio buttons, and sliders as are well known in the computer interface arts), information in the form of files (such as new or improved programs), and updated setpoints. In some instances, the user is an individual or a computer associated with the vendor or supplier of the system.

The system of the invention can be programmed to operate at specific times, for example, during the evening or night when the areas of interest are not being used. Sensors can be used to detect the presence of players (including the data provided by any one or more of motion detection by motion sensors, visual images provided by electronic cameras, and sound detection by microphones) so that operation of certain features of the invention, such as the irrigation system, can be overridden or suppressed at appropriate times. In an alternative embodiment, infrared sensors are provided to detect infrared signals that may represent body heat or heat from a motor of a vehicle, such as a golf cart. In order to determine whether detected motion is caused by intruders, the system can activate one or more lights to permit visual signals to be recorded at night.

The control of a specific area of interest 28 can be accomplished using local control module C. In such instances, the local control module comprises a controller such as a PC, a PLC, or another microprocessor-based controller. The local control module operates software or a control logic sequence to receive data from one or more sensors, and to analyze the data to determine if any remedial action is necessary. If remedial action is needed, the local control module institutes the remedial action, and terminates the remedial action when a suitable outcome is obtained. The local control module in such an instance communicates with the programmable master control module to provide status information, so that a user of the system can be fully apprised of what transpires.

In some instances, a user of the system interacts with local control module C of a specific area of interest in a local mode. For example, when on site, a greens keeper can operate a local control module to perform a necessary operation of the subsurface aeration subsystem dedicated to the area of interest. The greens keeper might want to make specific adjustments, perform maintenance, or otherwise personally oversee an operation of the system at that location. Conveniently, a user can communicate with and control a local control module using a local display and a touch pad, a touch screen, a keyboard, or another convenient interface. Keyboards proving access by way of infrared interfaces, such as an IrDA interface, are also known. The user can communicate with at least one of the local control modules that further comprises a communication link accessible by way of a hand held battery-powered device. In one embodiment, the hand-held battery-powered device is a selected one of a cellular telephone, a personal digital assistant (PDA), and a pocket personal computer (pocket PC), which the user uses to gain access the local control module and to operate it, and thereby the specific subsurface aeration subsystem.

Programmable master control module B preferably provides a data logging capability and a data trending capability. The data logging and trending capabilities can be provided using any commercial database management software, proprietary database management software, and/or spreadsheet software. Data logging and trending is well known in the information technology arts, and will not be discussed at length herein.

The system provides fault detection capability. The programmable master control module (by way of a local control module) may monitor the status of components of the system. For example, the local control module can determine if a motor is drawing excessive power, or if the air flow rate is untypically low. The fault condition can be exhibited or enunciated to a user at any of a local control module, the programmable master control module, and a remote location when a user communicates with the system from such a remote location.

Figure 4:
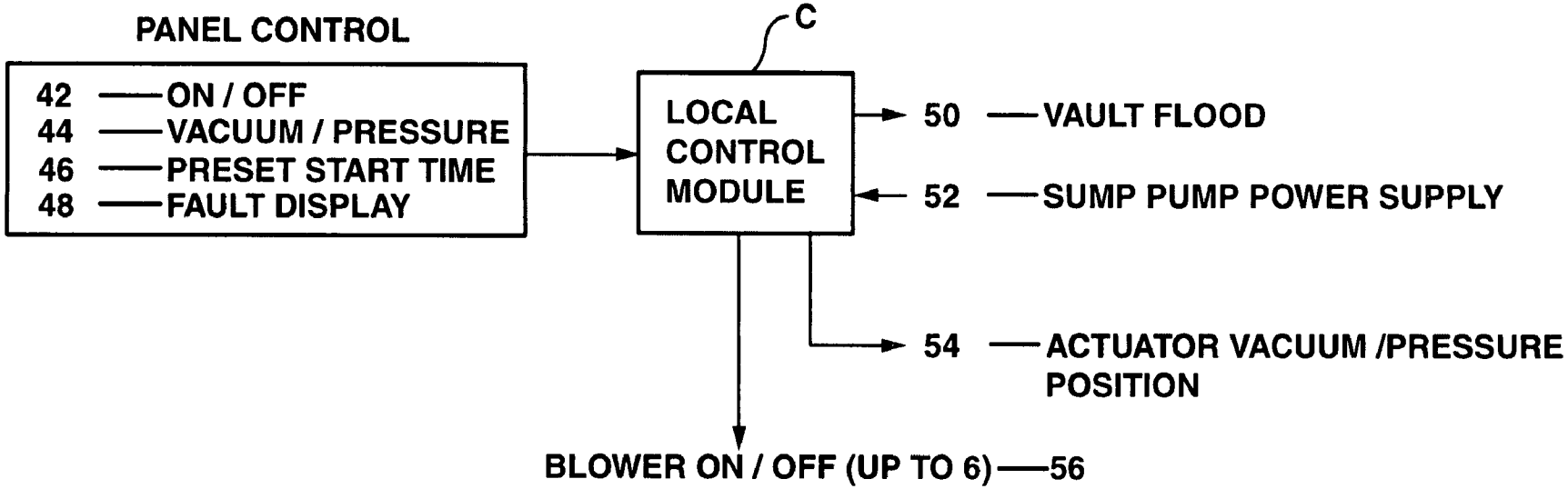
FIGS. 4–7 are drawings depicting exemplary embodiments of a local control module with different features, according to principles of the invention.

FIGS. 4–7 are drawings depicting examples of local control module C with different features. FIG. 4 shows an embodiment of a local control module C that has a basic complement of features, including the ability to control the on or off state 42 of motor-air pump 34, the ability to control whether the motor-air pump operates to provide air pressure or to provide a partial vacuum 44, the ability to define a preset start time 46 for operating the subsurface aeration subsystem controlled by the local control module, and the ability to display fault conditions 48. The local control module C also has the ability to sense a flood condition 50 in a vault (e.g., water entering the vault) in which the motor-air pump and other components are secured, and can provide power 52 to operate a sump pump and/or its associated power supply so as to prevent or counteract the flooding condition. The local control module can send a command 54 to the reversing valve to determine a partial vacuum or air pressure configuration (e.g., actuator vacuum/pressure position). The local control module can send a command 56 to activate or to deactivate the motor-air pump, and in some embodiments, can activate/deactivate any number fixing air pump devices. A vault may be located below ground or above ground. With an above ground vault, the controls are located in an enclosure within the vault. For a below ground vault, the controls are located in an enclosure mounted above ground and communication wires connect it to the devices located within the vault.

Figure 5:
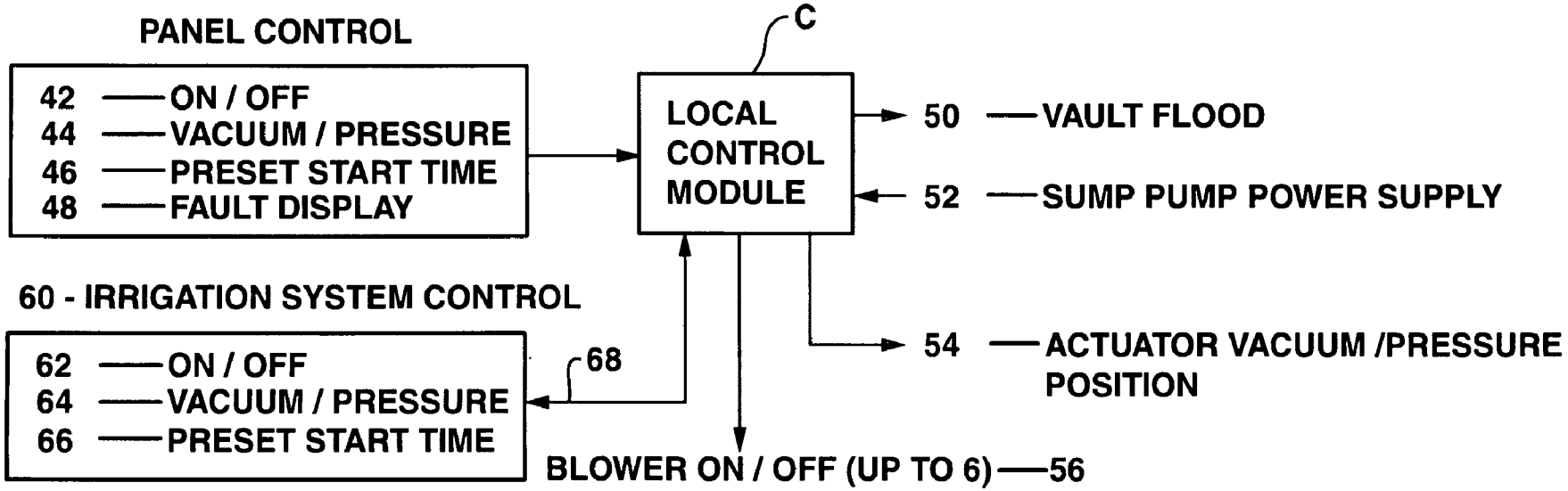

FIG. 5 shows another embodiment of local control module C that has the basic complement of features shown in FIG. 4 and in addition, the optional feature of controlling an irrigation system 60. In some embodiments, the irrigation system can operate according to commands generated by a controller associated with the irrigation system 60 itself, and, using bi-directional communication channel 68, can communicate information such as an on or off state 62, whether it is operating when the aeration system is configured in one of partial vacuum operation or air pressure operation, and commanded to begin operation at an optional preset start time 66. In other embodiments, the irrigation system 60 can be commanded, using bi-directional communication channel 68, to turn on and off 62, commanded to operate when the aeration system is configured in one of partial vacuum operation or air pressure operation 64, and commanded to begin operation at an optional preset start time 66. In some embodiments, the system can include logic to operate the irrigation system 60 to deliberately increase a moisture content of the soil when adding water is appropriate.

Figure 6:
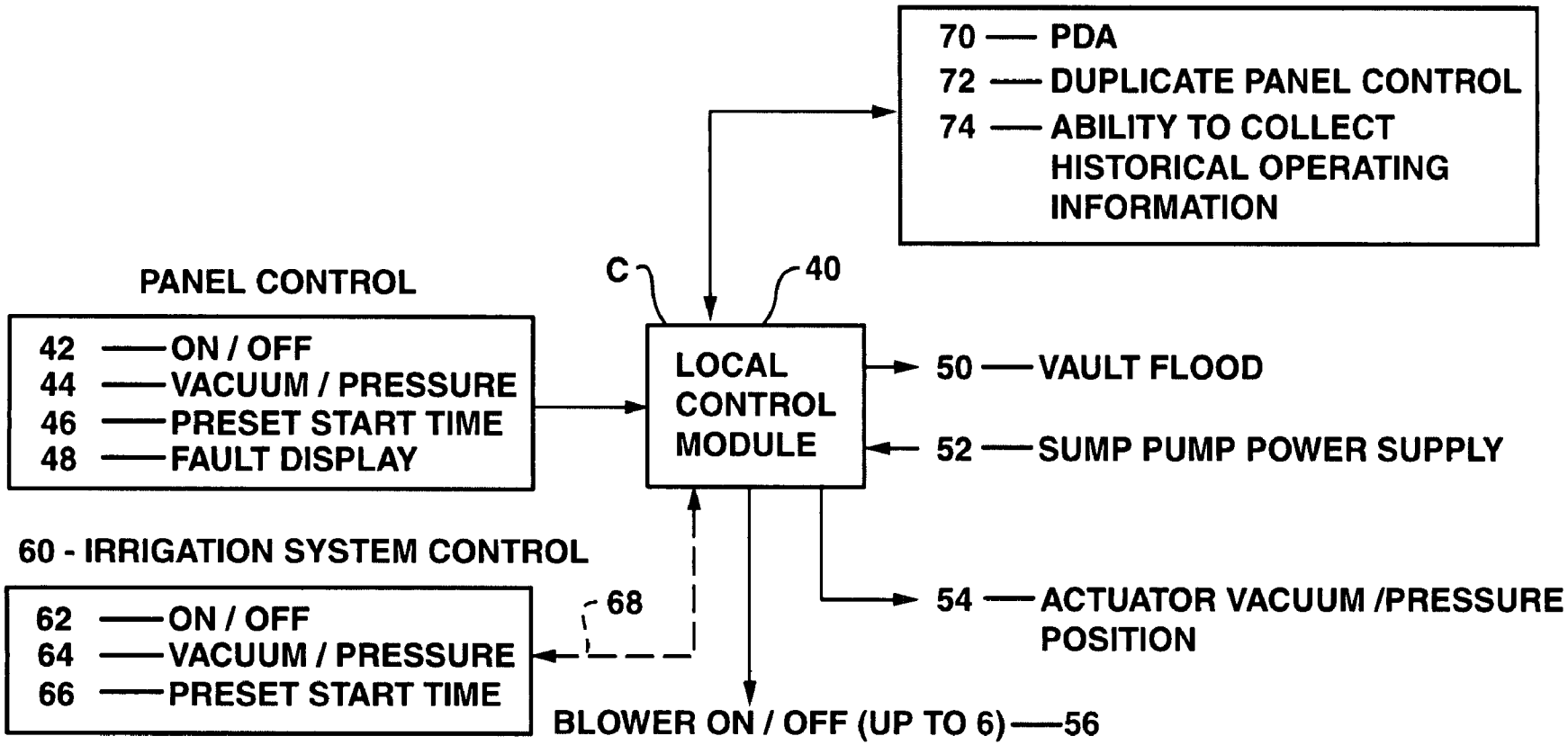

FIG. 6 shows another embodiment of local control module C that has the basic complement of features shown in FIGS. 4 and 5 and, in addition, the feature of using a PDA 70 to duplicate all of the control features 72 of the local control module. The PDA 70 also provides the ability to collect historical operating information 74, for example for statistical data analysis and for trending analysis.

Figure 7:
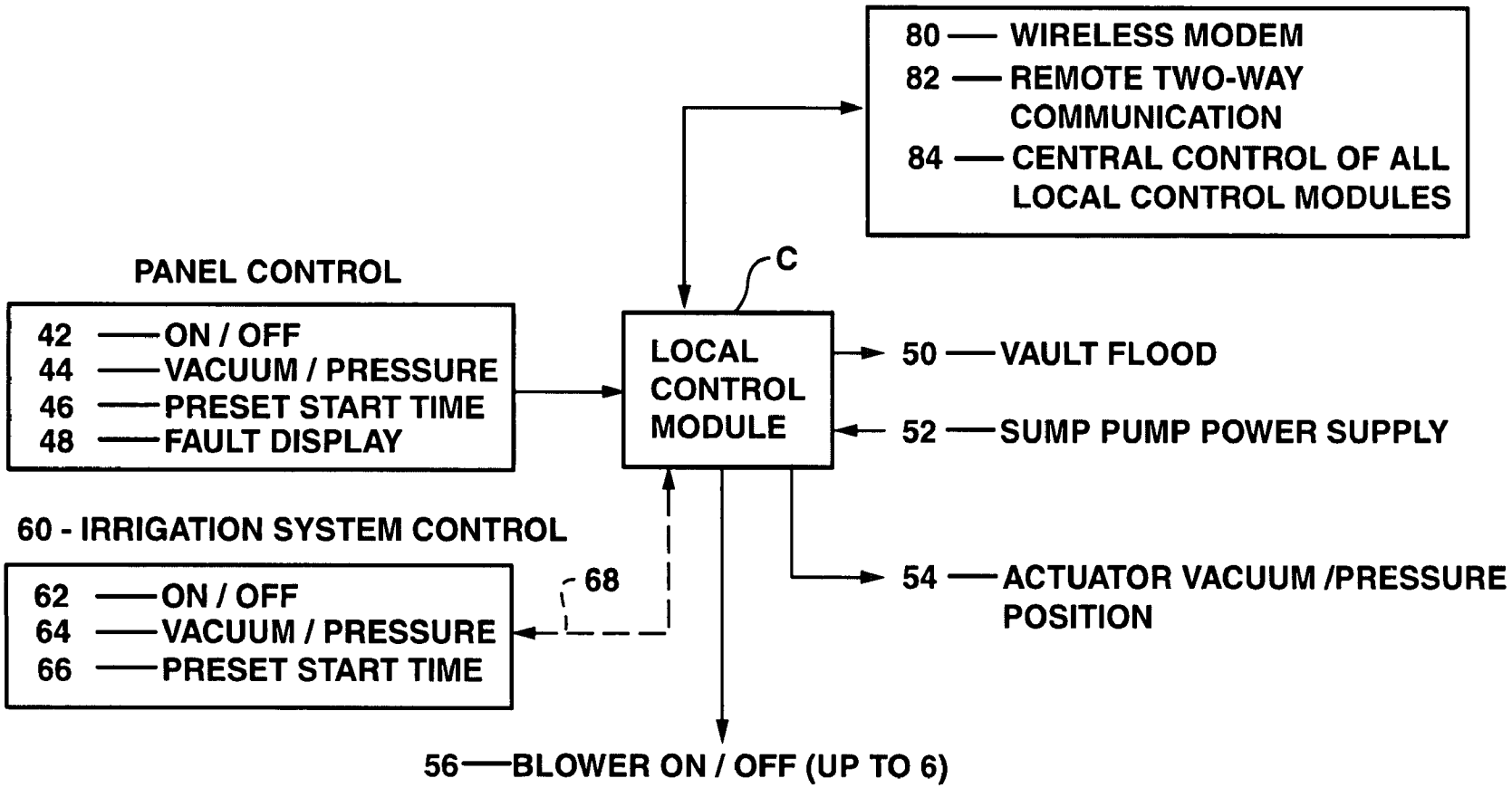
Figure 10:
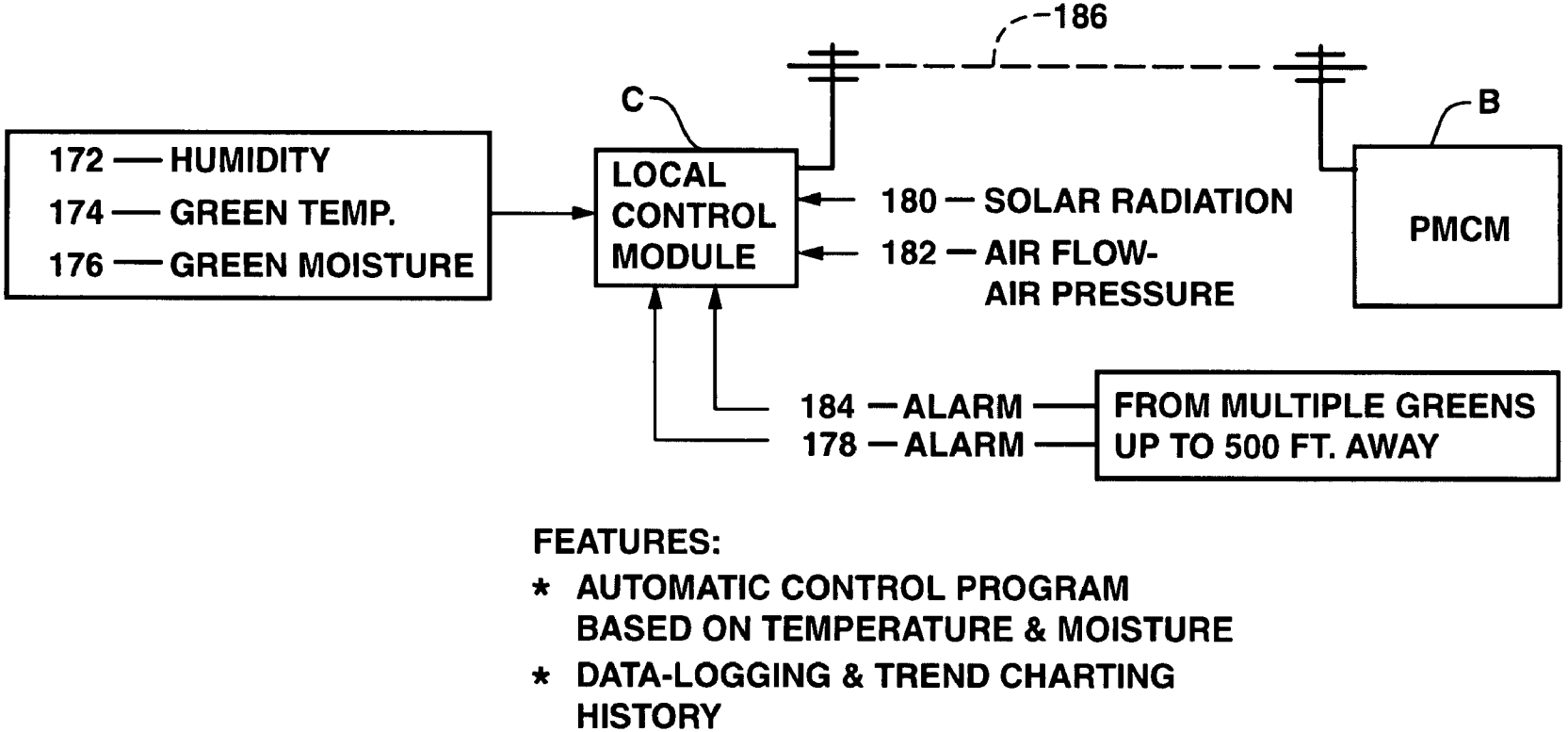
FIG. 10 is a diagram of an illustrative communication configuration including a local control module and a programmable master control module, and showing various environmental sensor signal paths, according to principles of the invention.
Figure 11:
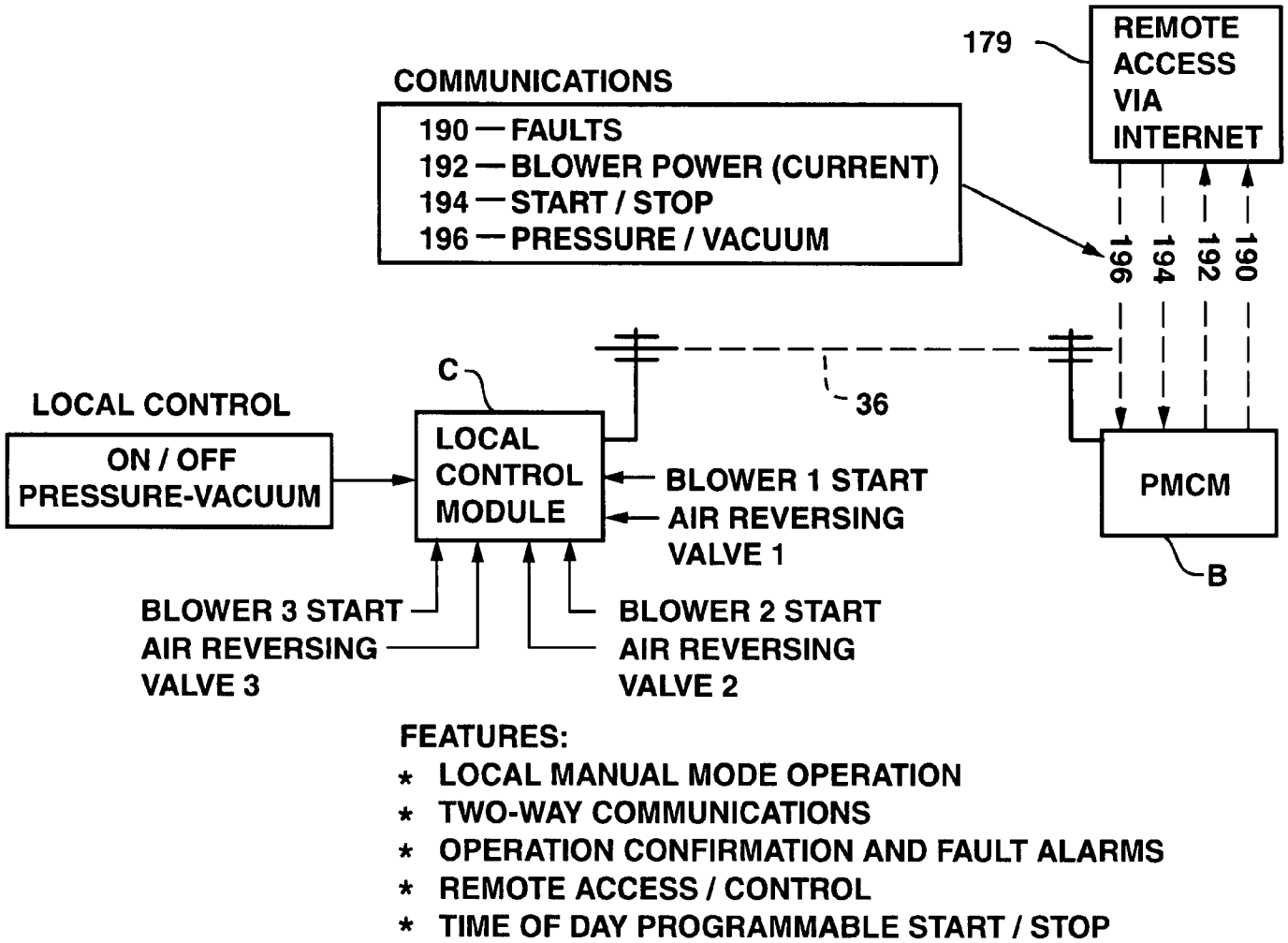
FIG. 11 is a diagram showing an exemplary configuration of communication paths including remote access via the Internet, according to principles of the invention.

FIG. 7 shows a local control module C that has the basic complement of features shown in FIGS. 10 and 11 and, in addition, the feature of using a wireless modem 80 to provide remote two way communication 82 with the local control module C. The wireless modem 80 provides the ability to control all of the local control modules from a central location 84, for example using a personal computer situated in a clubhouse of a golf course.

Figure 8:
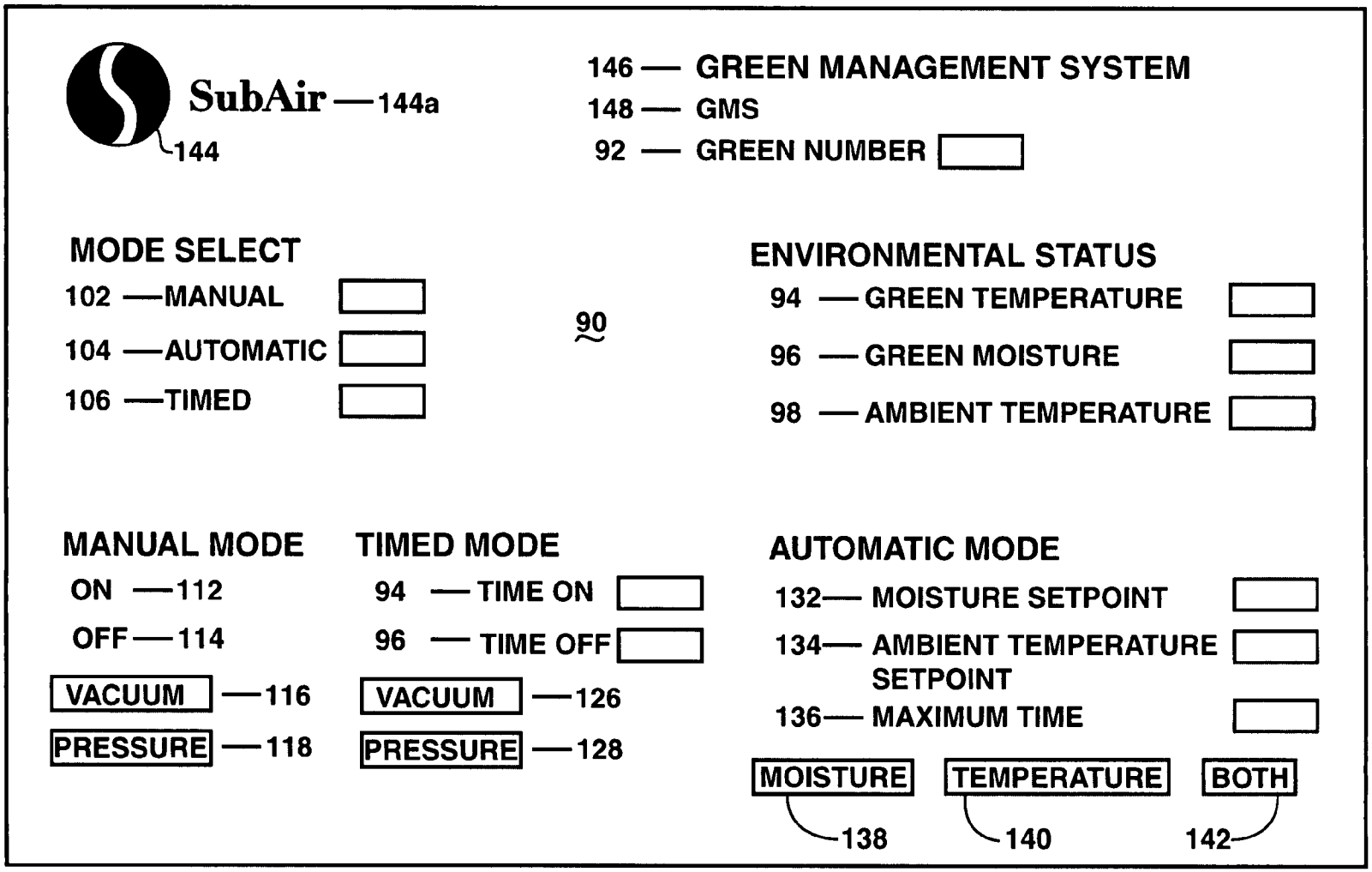
FIG. 8 is a drawing showing an exemplary embodiment of a user display, according to principles of the invention.

FIG. 8 illustrates an exemplary embodiment of a user display 90. In one embodiment, the user display is provided on any or all of a computer monitor, a PDA display screen, and a cellular telephone display screen, and may be a touch screen. In the embodiment of FIG. 8, the display areas presented to a user include the following: an identifier "GREEN NUMBER" and a display box 92 in which a number is displayed; an identifier "ENVIRONMENTAL STATUS" with three data identifiers, namely "green temperature," "green moisture," and "ambient air temperature," followed respectively by regions 94, 96, 98 in each of which a number is displayed, for example temperature in either degrees Fahrenheit or degrees Celsius, and moisture content as a percentage; a "SELECT MODE" identifier, with three possible modes, identified as "manual," "automatic," and "timed," followed respectively by regions 102, 104, 106 that can be "buttons" such as are commonly presented to a user of a computer in a graphical user interface ("GUI") such as Microsoft Windows™, or they can be regions that are activated by a key press or mouse click, so that a user is informed which mode is selected for example by illumination, by color change, by highlighting such as flashing, or by any other convenient visual indication; and at the bottom of the display, three regions comprising "buttons" or indicators, one each for "MANUAL MODE," "TIMED MODE," and "AUTOMATIC MODE." In the event that "manual mode" is selected, the user can turn the motor-air pump on or off, by activating a respective one of indicators 112, 114, and can select provision of partial vacuum or air pressure during operation by activating a respective one of indicators 116, 118. The indicators 112, 114, 116 and 118 can be regions similar to the regions 102, 104 and 106. In the event that the "timed mode" is selected, numerical indications of time (e.g., in a format such as hours, minutes with or without an AM or PM indication) appear in regions 94 and 96, which respectively indicate a time for the controlled motor-air pump to start, and a time for the controlled motor-air pump to stop operation, as well as indicators 126 and 128, which as similar to indictors 116 and 118, and which respectively indicate operation with provision of partial vacuum or air pressure. In the event that "automatic mode" is selected, the display indicates a moisture setpoint in region 132, an ambient air temperature setpoint in region 134, and an optional maximum time of operation in region 136. The automatic mode when active deals with moisture and temperature excursions from desired values, and can indicate, by activating indicators 138, 140, and 142, whether the automatic system is operating to deal with an excursion in moisture content, an excursion in temperature, or excursions in both parameters, by activating a respective one of indicators 138, 140 and 142. In some embodiment, the display 90 can further include a logo 144, a vendor name 144*a*, and an indication that the system is a "GREENS MANAGEMENT SYSTEM" 146 (or GMS 148).

Figure 9:
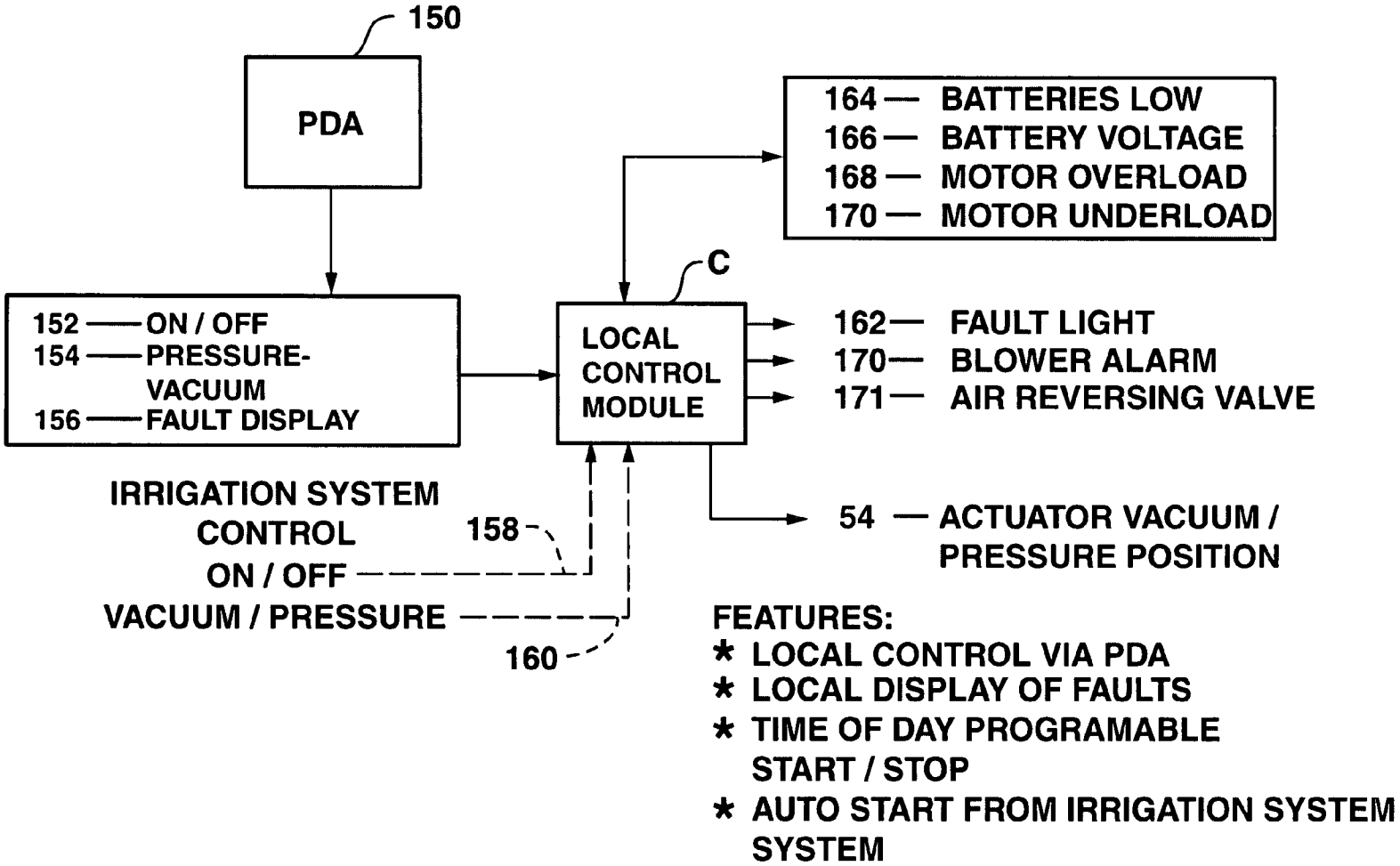
FIG. 9 is a diagram of an exemplary local control module, showing various control signal paths, according to principles of the invention.

FIG. 9 is a diagram of an exemplary local control module C, showing various control signal paths. Local control module C receives signals from a PDA 150 module indicating the on/off condition 152 of a motor-air pump, the air pressure/partial vacuum configuration 154 of a reversing valve, and a timer on/off time 156. The local control module may receive information about the condition 158 of an optional irrigation system, including whether the irrigation system is on or off, and whether the irrigation system is configured to operate when the reversing valve is configured to provide air pressure or partial vacuum 160. Local control module C provides signals indicating the presence of a fault 162, for example by illuminating a fault light, which can indicate any of the conditions of low batteries 164 (optional), a problem in the vault 166 such as flooding, a motor overload 168, and a motor underload 170. A signal 170 is provided to indicate that the motor-air pump is starting (or is operating), and a signal 171 is provided to indicate the configuration of the reversing valve (e.g., providing air pressure or partial vacuum). The local control module can in some embodiments receive signals from other hand held controllers, such as cellular telephones, and can communicate as well with the programmable master control module.

FIG. 10 is a diagram of an illustrative communication configuration including local control module (LCM) C, programmable master control module (PMCM) B, and showing various environmental sensor signal paths. In FIG. 10, the local control module receives a variety of environmental signals from sensors, including humidity 172, green (or soil) temperature 174, green (or soil) moisture 176, ambient air temperature 178, solar radiation level 180, air flow/air pressure 182 in a conduit and other signals 184. The data collected by local control module C is communicated, in one embodiment, by wireless communication link 186 to programmable master control module B FIG. 11 is a diagram showing an exemplary configuration of communication paths including remote access via the Internet. In the embodiment shown in FIG. 11, local control module C communicates by radio modem with programmable master control module B, which in turn is (optionally) in communication with a remote access site connected by way of the Internet 179. Local control module receives signals S from a sensor that monitors the current provided to the motor-air pump. The local control module, in the embodiment of FIG. 11, controls three subsurface aeration subsystems, and can issue commands C1, C2, C3 to turn motors on and off, and to control a configuration of a reversing valve. The local control module sends information to programmable master control module B, and receives directives from the programmable master control module. In turn, the programmable master control module communicates fault conditions 190, status information such as motor-air pump power and/or current 192 and the like to remote access site 179 which is manned by a user. The information sent to the remote access site, which may be a personal computer, can be any information that would be displayed to a user on the display screen 90, as well as other information useful for statistical analysis and trending analysis. The user at the remote access site 179 can issue commands including, for example, start and stop commands 194 for a motor-air pump, and configuration commands 196 to configure a reversing valve to provide a selected one of air under pressure or a partial vacuum. Programmable master control module B in turn issues directives 36 to local control module C, by which directives the local control module is instructed to carry out the commands of the user operating the remote access site 179.

FIG. 12 is an enumeration of some of the components, communication and control channels, and logic structure of one or more embodiments of the golf course environmental management system. The components enumerated include an equipment panel and various field devices. The equipment panel is one example of the local control module described hereinabove. The field devices include a high pressure air pump, an air reversing valve and actuator, a sump pump, a float switch, a moisture/soil temperature sensor, and an ambient air temperature sensor, as well as associated operational equipment such as a local electrical disconnect, a transformer, a motor contactor, a current switch, a motor overload indicator, relays for various purposes, such as starting the motor and operating the actuator for the air reversing valve, a panel door switch and a fault light on the panel door. Some of the field devices are optional in some embodiments. FIG. 12 describes in overview some of the communication and control lines that are provided in some embodiments, and the signals that pass along the communication and control lines. In one embodiment, the description of the communication and control refers to control signals and status signals that are communicated to and from the programmable master control module described hereinabove. The logic requirements, such as air pump on based on time of day, or air pump on based on temperature and or moisture, can be implemented by local control module itself, or by the programmable master control module (or by a user of the system) and communicated as a directive to the local control module.

In another aspect, the invention includes a method for managing a golf course environment which includes extracting water from a specific area of interest selected from areas of interest within a golf course. The method comprises the steps of providing a subsurface aeration system at the areas of interest, and operating a subsurface aeration system at the specific area of interest to provide a partial vacuum when the moisture reading exceeds a setpoint value, thereby extracting water from the specific area. Each subsurface aeration system comprises a conduit for providing to the specific area of the golf course at least a partial vacuum; an air pump in fluid communication with the subsurface aeration conduit. The air pump is configured to provide one of a partial vacuum and a pressure in the conduit. A motor is mechanically connected to the air pump, and at least one sensor provides a moisture reading of the area of interest. Advantageously, the method further comprises providing a control module responsive to a directive and to the moisture reading. The control module is coupled to the subsurface aeration system to control and cause the subsurface aeration system to operate to extract water in response to the directive and to a determination that the moisture content exceeds the setpoint value.

A programmable master control module may be provided in communication with the control module, receiving information representing the moisture content sent from the control module. The method includes determining whether the moisture content exceeds the setpoint and, if the determination is positive, issuing from the programmable master control module the directive to the local control module to operate the subsurface aeration subsystem.

In another aspect, the invention relates to a method of reducing a temperature of soil in a specific area of interest within a golf course. The method comprises operating a subsurface aeration system at the specific area when the ambient air temperature is sufficiently less that the soil temperature as determined by a prescribed amount or temperature difference at the specific area to reduce a soil temperature. The prescribed temperature may be determined using temperature setpoints and sensor readings. In that case the aeration system operates to provide at least a partial vacuum when the ambient air temperature is lower than or equal to a first setpoint value, the soil temperature is higher than or equal to a second setpoint value, and the first setpoint value is less than the second setpoint value, thereby drawing ambient air through the specific area of interest to reduce a soil temperature thereof. In an example, the turf species is Bentgrass (cool weather grass), the season is summer, and the time of day is night time. The soil temperature is 80 F, the air temperature is 60 F, and the subsurface (about 2 to 4 feet below ground) temperature is 70 F. The air pump operates in vacuum to pull the cool nighttime air down into the root zone soil to reduce temperatures. Examples of setpoints are S1=70 F and S2=80 F. While a ten point difference in setpoints (F) is preferred for establishing efficient and effective heat transfer to cool or heat air, point spreads in the 3 to 4 degree range may be sufficient in some applications.

Further, the method comprises providing a control module responsive to a directive, to the ambient air temperature, and to the soil temperature. The control module is coupled to the subsurface aeration system to control the operation thereof. When it is determined that the ambient air temperature is lower than or equal to a first setpoint value, the soil temperature is higher than or equal to a second setpoint value, and the first setpoint value is less than the second setpoint value, the local control module causes the subsurface aeration system to operate and reduces the temperature of soil. The method may comprise repeating from time to time the determination step, and when the determination is positive, directing the local control module to operate the subsurface aeration system to reduce a temperature of soil.

Advantageously, the method comprises providing a programmable master control module in communication with the control module, and receiving at the programmable master control module information sent from the control module representing the ambient air temperature and the soil temperature and, if the determination is positive, issuing from the programmable master control module the directive to the local control module to operate the subsurface aeration subsystem to reduce a temperature of soil.

In yet a further aspect, the invention features a method of reducing a temperature of soil in a specific area of interest by operating a subsurface aeration system to provide air under pressure when the ambient air temperature is higher than or equal to a first setpoint value, the soil temperature is higher than or equal to a second setpoint value, the first setpoint value is higher than the second setpoint value, and the soil moisture content is less than a third setpoint value. In this method air under pressure is pushed through the specific area to reduce a soil temperature thereof. A sensor that measures an ambient air temperature; a sensor that measures a soil temperature; and a sensor that measures soil moisture content are provided. In an example, the turf species is Bentgrass (cool weather), the season is summer, and the time of day is daytime. The soil temperature is 80 F, the air temperature is 95 F, and the subsurface temperature is 70 F. The air pump operates in pressure to push the warm ambient air through the cool subsurface soil and move the cooled air to the root zone to reduce temperatures. Examples of setpoints are S1=90 F and S2=80 F.

In another aspect, the method comprises providing a control module coupled to the subsurface aeration system to control its operation and determine whether the ambient air temperature is higher than or equal to a first setpoint value, the soil temperature is higher than or equal to a second setpoint value, the first setpoint value is higher than the second setpoint value, and the soil moisture content is less than a third setpoint value. If the determination is positive, the subsurface aeration system is operated to reduce the temperature of the soil. The determination step may be repeated from time to time, and when the determination is positive, the local control module is directed to operate the subsurface aeration system to reduce a temperature of the soil.

The method further comprises providing a programmable master control module in communication with the control module, and receiving at the programmable master control module information sent from the control module representing the ambient air temperature, the soil temperature, and the soil moisture content. If the determination step is positive a directive issues from the programmable master control module to the local control module causing the subsurface aeration subsystem to operate and reduce a temperature of soil. Preferably, cooled air under pressure is provided by ambient air that has been cooled by passing it through at least a portion of the subsurface aeration conduit configured as a heat exchanger in contact with subsurface soil.

Again, the method preferably comprises repeating from time to time the determining step, and when the determination is positive, issuing from the programmable master control module the directive to the local control module to operate the subsurface aeration subsystem to reduce a temperature of soil.

In another aspect, the invention relates to a method of increasing a temperature of soil in a specific area of interest within a golf course by operating a subsurface aeration system to provide air under pressure when a determination is made that the ambient air temperature is lower than or equal to a first setpoint value, the soil temperature is lower than or equal to a second setpoint value, the first setpoint value is lower than the second setpoint value, and the soil moisture content is less than a third setpoint value. This causes cold air under pressure to be forced through the warner subsurface soil beneath a specific area of interest causing the warmed air to flow up to the turf to increase a soil temperature thereof. In an example, the turf species is Bermuda (warm weather) or Bentgrass (cool weather), and the time of day is morning or evening. The soil temperature is 50 F, the air temperature is 30 F, and the subsurface temperature is 60 F. The air pump operates in pressure to push the cold ambient air through the warm subsurface soil and to move the warmed air to the root zone soil to increase temperatures. Examples of setpoints are S1=40 F and S2=50 F.

In still a further aspect, the invention relates to a method of increasing a temperature of soil in a specific area of interest within a golf course by operating the subsurface aeration system to provide at least a partial vacuum when a determination is made that the ambient air temperature is greater than or equal to a first setpoint value, the soil temperature is lower than or equal to a second setpoint value, and the first setpoint value is higher than the second setpoint value. In this manner, ambient air is drawn downward through the specific area to increase a soil temperature thereof. In an example, the turf species is Bermuda (warm weather), the season is spring or fall, and the time of day is midday. The soil temperature is 50 F, the air temperature is 80 F, and the subsurface temperature is 60 F. The air pump operates in vacuum to pull the warm daytime air down into the root zone soil to increase temperatures. Examples of setpoints are S1=70 F and S2=60 F.

In the above methods for increasing a soil temperature of a specific area, the method preferably includes providing control modules responsive to a directive, and to the ambient air and soil temperatures, coupled to the subsurface aeration systems at the areas of interest, and controlling the operation thereof to increase a temperature of the soil at one or more specific areas. The method may comprise repeating from time to time the determining step, and while the determination is positive, directing the local control modules to operate the subsurface aeration systems to increase a temperature of soil.

A programmable master control module is provided in communication with the control modules, and receiving at the programmable master control module information sent from the control module representing the ambient air temperature and the soil temperature. When the determinative step is positive, the programmable master control module issues a directive to the local control module to operate the subsurface aeration subsystem to increase a temperature of soil.

As should be evident from the disclosure above, systems embodying principles of the invention provide an effective means for treating areas of interest to affect a desired soil temperature changes. At the same time, the systems can be utilized to promote drainage in these regions as well as providing for turf root zone aeration. The systems can be easily retrofitted to existing golf greens or other similar underground drainage systems or incorporated into new construction.

Although the invention has been described with reference to the use of a flow reversing valve, a valve can be replaced by a universal coupling that permits the drainage system to be selectively coupled to either the discharge or the suction port of the air pump. This, combined with the use of a mobile unit, provides for an economically feasible system for treating multiple greens that have appropriate drainage systems. Stationary systems embodying the apparatus of the present invention are contained below ground in specially prepared vaults and also located above ground inside an enclosure and that the local controls associated with the system are automatically operated so that the system is controlled from a remote location without having to enter the vault or enclosure. The principles of the invention can also be applied to California-style drainage systems and to other presently unknown configurations of golf course drainage systems.

Machine-readable storage media that can be used in the invention include electronic, magnetic and/or optical storage media, such as 3.25 inch magnetic floppy disks and hard disks, a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks); and electronic storage media, such as RAM, ROM, EPROM, Compact Flash cards, PCMCIA cards, or alternatively SD or SDIO memory; and the electronic components (e.g., floppy disk drive, DVD drive, CD/CD-R/CD-RW drive, or Compact Flash/PCMCIA/SD adapter) that accommodate and read from and/or write to the storage media. As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and such machine-readable symbols as one and two dimensional bar codes.

Those of ordinary skill will recognize that many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein.

While a preferred embodiment of the invention has been described using specific terms, such description is for illustrative purposes only, and it is to be understood that changes and variations may be made without departing from the spirit or scope of the following claims.

What is claimed is:

1. A system for managing a plurality of areas of interest within a golf course, comprising:

a plurality of subsurface aeration subsystems associated with said areas of interest;

subsurface aeration conduits for providing to said areas of interest at least one of air under pressure and a partial vacuum;

air pumps in fluid communication with said subsurface aeration conduits configured to provide at least one of air under pressure and a partial vacuum with said conduits;

drive motors mechanically connected to said air pumps;

local control modules responsive to a directive operatively coupled to said drive motors; and sensors for measuring at least one environmental parameter at said areas of interest in communication with said local control modules; and a master control module in communication with said local control modules;

whereby said master control module receives from said local control modules area information including information representing said at least one environmental parameter and, in response to said area information, said master control module issues a directive to said local control modules to operate said subsurface aeration subsystems.

2. The system of claim 1 wherein said environmental parameter includes ambient air temperature, and said master control module issues a directive for reducing the temperature of the soil by operating the subsurface aeration system to draw air downwardly through the specific area under a vacuum when said ambient air is less than a soil temperature by a prescribed amount.

3. The system of claim 2 including environmental parameters of ambient air temperature and soil moisture content, and said master control module issues a directive for reducing the temperature of the soil by operating the subsurface aeration system to push air upwardly through the specific area under pressure to reduce a temperature of soil when said ambient air is greater than the soil temperature by a prescribed amount, and said soil moisture content is below a setpoint.

4. The system of claim 1 including environmental parameters of ambient air temperature and soil moisture content, and said master control module issues a directive for reducing the temperature of the soil by operating the subsurface aeration system to create an air flow upwardly through the specific area under pressure to reduce a temperature of soil when said ambient air is greater than the soil temperature by a prescribed amount, and said soil moisture content is below a setpoint.

5. The system of claim 4 wherein said subsurface aeration systems include heat exchangers in heat exchange relationship with said aeration conduits for cooling said air flow under pressure.

6. The system of claim 1 including an environmental parameter of ambient air temperature and a function of soil temperature, and said directive causes said subsurface aeration system to establish said vacuum in said aeration conduit so that air is drawn downward though the soil at the area of interest for increasing the temperature of the soil when said ambient temperature is greater than a soil temperature.

7. The system of claim 6 including an environmental parameter of said moisture content and wherein said directive instructs said subsurface aeration system to establish an air flow under pressure in said aeration conduit so that air flows upward through the soil for increasing a temperature of soil at the area of interest when said ambient air is sufficiently lower than the soil temperature, the subsurface is sufficiently warmer than the soil, and said soil moisture content is below a setpoint.

8. The system of claim 1 including environmental parameters of ambient air temperature, a function of soil temperature, and soil moisture content wherein said directive instructs said subsurface aeration system to establish an air flow under pressure in said aeration conduit so that air flows upward through the warmer subsurface thereby increasing the air temperature and moving that warmed air upward for increasing a temperature of soil at the area of interest when said ambient air is sufficiently less than the soil temperature, and said soil moisture content is below a setpoint.

9. The system of claim 1 wherein said master control module is in communication with said local control modules by one of a hard-wired communication link, a wireless communication link, and a fiber-optic communication link.

10. The system of claim 1 wherein said master control module includes a connection to a communication network which includes one of a telephone communication link, a wireless communication link, an optical communication link, and a packet-switched communication link so that said master control module may be accessed from a remote location.

11. The system of claim 10 wherein said master control module can communicate information over said selected communication link to a user at a remote location, and wherein said master control module can receive a command over said selected communication link from a user at a remote location.

12. The system of claim 1 wherein said local control modules include communication links accessible by way of a hand-held battery-powered device selected from one of a cellular telephone, a personal digital assistant (PDA), and a pocket personal computer (pocket PC).

13. The system of claim 1 wherein said subsurface aeration subsystems includes reversing mechanisms responsive to said local control modules in fluid communication with said air pumps and said subsurface aeration conduits, said reversing mechanisms being configured to cause air to flow in a first flow direction to provide said air under pressure, and to cause air to flow in a second flow direction to provide said partial vacuum.

14. The system of claim 1 wherein said sensors measure one of an air temperature, soil temperature, a moisture content, an illumination, a time, and a motion.

15. The system of claim 1 wherein said programmable master control module comprises a data recording and analysis module, said data recording and analysis module is configured to record and analyze one of a parameter relating to aeration, an operating parameter of an air pump, an air temperature, a soil temperature, a moisture content, and a time.

16. The system of claim 15 wherein said data recording and analysis module is configured to compare a selected parameter to a setpoint.

17. The system of claim 15 wherein said data recording and analysis module is configured to determine a status of said subsurface aeration subsystems selected from one of a time when said subsurface aeration subsystem begins to operate, after a duration of operation of said subsurface aeration subsystem, and responsive to an operating parameter of said subsurface aeration subsystem, a environmental condition, a fault condition, an actionable condition, a setpoint, and a directive.

18. The system of claim 17 wherein said operating parameter of said subsurface aeration subsystem comprises one of an electrical current, a pressure, a temperature a vacuum, an air flow, and a water flow.

19. The system of claim 17 wherein said environmental condition comprises one of a soil temperature, an ambient temperature, a moisture content, an amount of solar radiation received in a specified time period, a soil salinity, and a detection of motion.

20. A method for managing the environment of a plurality of areas of interest within a golf course wherein subsurface aeration systems are provided at the areas of interest, each subsurface aeration system being dedicated to a specific area of interest and including a conduit for providing to the specific area at least a partial vacuum, an air pump in fluid communication with the subsurface aeration conduit, the air pump configured to provide said at least a partial vacuum in the conduit, a drive motor mechanically connected to the air pump, and at least one sensor that provides a moisture reading of the specific area, said method comprising the steps of:

providing control modules responsive to a directive and to the moisture reading and coupled to said drive motors for controlling the subsurface aeration systems;

providing a master control module in communication with said control modules;

receiving at the master control module area information sent from the control modules, representing the moisture content;

determining whether the moisture content exceeds a setpoint value; and operating said subsurface aeration systems at the specific areas of interest to provide at least a partial vacuum when the moisture reading exceeds said setpoint value to remove excess water from the specific areas.

21. A method for managing the environment of a plurality of areas of interest within a golf course comprising the steps of:

providing a plurality of subsurface aeration systems at the areas of interest, each subsurface aeration system being dedicated to a specific area of interest and including a conduit for providing to the specific area one of a vacuum and air under pressure for reducing a temperature of the soil, an air pump in fluid communication with the subsurface aeration conduit configured to establish said one of a vacuum and air under pressure in the conduit, a motor mechanically connected to the air pump, and a sensor that measures an ambient air temperature;

providing local control modules coupled to associated ones of said subsurface aeration systems to control the operation thereof in response to a directive;

providing a master control module in communication with said local control modules;

receiving at the master control module area information sent from said local control modules representing the ambient air temperature;

determining whether a condition exists for reducing the temperature of the soil at an area of interest in response to receiving said ambient air temperatures;

if the condition exists, issuing a directive from the master control module to one or more local control modules causing operation of an associated subsurface aeration system to create a an air flow in an aeration conduit for reducing a temperature of soil at the area of interest.

22. The method of claim 21 including connecting said master control module in communication with said local control modules by one of a hard-wired communication link, a wireless communication link, and a fiber-optic communication link.

23. The method of claim 21 including accessing said local control modules by way of a hand-held battery-powered device selected from one of a cellular telephone, a personal digital assistant (PDA), and a pocket personal computer (pocket PC).

24. The method of claim 21 wherein determining said condition includes determining whether said ambient air temperature is less than a soil temperature by a prescribed amount, and said directive causes said subsurface aeration system to establish said vacuum in said aeration conduit so that air is drawn downward though the soil at the area of interest for reducing the temperature of the soil.

25. The method of claim 24 wherein determining whether the ambient temperature is less than a soil temperature includes determining whether the ambient air temperature is lower than or equal to a first setpoint value, the soil temperature is higher than a second set point value, and the first setpoint value is less than the second setpoint value.

26. The method of claim 24 comprising repeating from time to time the determining step and, when the condition exists, issuing from the master control module a directive to one or more local control modules to operate said associated subsurface aeration systems for reducing a temperature of the soil.

27. The method of claim 24 including receiving at the programmable master control module area information sent from the control module representing ambient air temperature, soil temperature, and soil moisture content; and wherein determining the condition includes determining whether the ambient air temperature is greater than the soil temperature at an area of interest, and whether said soil moisture is below a setpoint; and said directive includes operating the subsurface aeration system to establish said air under pressure in said aeration conduit so that air flows upward through the soil for reducing a temperature of soil at the area of interest.

28. The method of claim 24 wherein determining if said ambient air is greater than the soil temperature includes determining whether said ambient air temperature is greater than or equal to a first setpoint value, the soil temperature is greater than or equal to a second setpoint value, the first setpoint value is lower than the second setpoint value; and the condition includes whether the soil moisture content is less than a third setpoint value.

29. The method of claim 27 including cooling said air by passing air through at least a portion of the subsurface aeration conduit configured as a heat exchanger in contact with subsurface soil when establishing air under pressure.

30. The method of claim 27 comprising repeating from time to time the determining step and, when the condition exists, issuing from the master control module a directive to one or more local control modules to operate said associated subsurface aeration systems for reducing a temperature of the soil.

31. The method of claim 21 wherein determining the condition includes determining whether the ambient air temperature is greater than the soil temperature at an area of interest, and said directive includes operating the subsurface aeration system to establish said air under pressure in said aeration conduit so that air flows upward through the soil for reducing a temperature of soil at the area of interest.

32. The method of claim 31 wherein determining if said ambient air temperature is greater than the soil temperature includes determining whether said ambient air temperature is greater than or equal to a first setpoint value, the soil temperature is greater than or equal to a second setpoint value, the first setpoint value is higher than the second setpoint value; and the condition includes whether the soil moisture content is less than a third setpoint value.

33. The method of claim 31 including cooling said air by passing air through at least a portion of the subsurface aeration conduit configured as a heat exchanger in contact with subsurface soil when establishing air under pressure.

34. The method of claim 31 comprising repeating from time to time the determining step and, when the condition exists, issuing from the master control module a directive to one or more local control modules to operate said associated subsurface aeration systems for reducing a temperature of the soil.

35. A method for managing the environment of a plurality of areas of interest within a golf course comprising the steps of:

providing a plurality of subsurface aeration systems at the areas of interest, each subsurface aeration system being dedicated to a specific area of interest and including an aeration conduit for providing to the specific area one of a vacuum and air under pressure for increasing a temperature of the soil, an air pump in fluid communication with the subsurface aeration conduit configured to establish one of said vacuum and air under pressure in the conduit, a motor mechanically connected to the air pump, and a sensor that measures an ambient air temperature;

providing local control modules coupled to associated subsurface aeration systems to control the operation thereof in response to a directive;

providing a master control module in communication with said local control modules;

receiving at the master control module area information sent from said local control modules representing the ambient air temperature;

determining whether a condition exists for increasing the temperature of soil at one or more areas of interest in response to receiving said ambient air temperature;

if the condition exists, issuing a directive from the master control module to one or more local control modules causing operation of an associated subsurface aeration system to establish one of said vacuum and air under pressure in the aeration conduit for increasing a temperature of soil at the area of interest.

36. The method of claim 35 wherein determining said condition includes determining whether said ambient air temperature is greater than a soil temperature by a prescribed amount, and said directive causes said subsurface aeration system to establish said vacuum in said aeration conduit so that air is drawn downward though the soil at the area of interest for increasing the temperature of the soil.

37. The method of claim 36 wherein determining whether the ambient temperature is sufficiently greater than a soil temperature includes determining whether the ambient air temperature is greater than or equal to a first setpoint value, the soil temperature is less than a second set point value, and the first setpoint value is greater than the second setpoint value.

38. The method of claim 36 comprising repeating from time to time the determining step and, when the condition exists, issuing from the master control module a directive to one or more local control modules to operate said associated subsurface aeration systems for increasing a temperature of the soil.

39. The method of claim 36 wherein determining the condition includes determining whether the ambient air temperature is sufficiently less than the soil temperature at an area of interest, and said directive includes operating the subsurface aeration system to establish said air under pressure in said aeration conduit so that air flows upward through the warmer subsurface and moves that warmed air up through the soil for increasing a temperature of soil at the area of interest.

40. The method of claim 39 wherein determining if said ambient air is sufficiently less than the soil temperature includes determining whether said ambient air temperature is sufficiently less than or equal to a first setpoint value, the soil temperature is sufficiently less than or equal to a second setpoint value, the first setpoint value is lower than the second setpoint value; and the condition includes whether the soil moisture content is less than a third setpoint value.

41. The method of claim 39 including heating said air by passing air through at least a portion of the subsurface aeration conduit configured as a heat exchanger in contact with subsurface soil when establishing a flow of said air under pressure.

42. The method of claim 35 wherein determining the condition includes determining whether the ambient air temperature is sufficiently less than the soil temperature at an area of interest, and said directive from said master control module includes operating the subsurface aeration system to establish said air under pressure in said aeration conduit so that air flows upward through the soil for increasing a temperature of soil at the area of interest.

43. The method of claim 42 including heating said air by passing air through at least a portion of the subsurface aeration conduit configured as a heat exchanger in contact with subsurface soil when establishing a flow of said air under pressure.

44. The method of claim 35 including connecting said master control module in communication with said local control modules by one of a hard-wired communication link, a wireless communication link, and a fiber-optic communication link.

45. The method of claim 35 including accessing said local control modules by way of a hand-held battery-powered device selected from one of a cellular telephone, a personal digital assistant (PDA), and a pocket personal computer (pocket PC).

* * * * *

UNITED STATES PATENT AND TRADEMARK OFFICE

CERTIFICATE OF CORRECTION

PATENT NO. : 7,172,366 B1
APPLICATION NO. : 11/400862
DATED : February 6, 2007
INVENTOR(S) : Robert F. Bishop, Jr.

It is certified that error appears in the above-identified patent and that said Letters Patent is hereby corrected as shown below:

Title page, item [63] Related U.S. Application Data: should read as follows:

Continuation of Serial No. 11/331,793, filed January 12, 2006, now abandoned; which is a continuation of Serial No. 10/935,205, filed September 7, 2004, now U.S. Patent 6,997,642; which is a continuation-in-part of Serial No. 10/777,491, filed February 12, 2004, now abandoned; and which is based on provisional application Serial No. 60/447,169, filed on December 12, 2003.

Signed and Sealed this

Second Day of September, 2008

JON W. DUDAS
*Director of the United States Patent and Trademark Office*